US008859470B2

(12) United States Patent
Ikezawa

(10) Patent No.: US 8,859,470 B2
(45) Date of Patent: Oct. 14, 2014

(54) LUBRICATING GREASE COMPOSITION

(75) Inventor: Atsushi Ikezawa, Kanagawa (JP)

(73) Assignee: Dow Corning Toray Company, Ltd., Chiyoda-Ku, Tokyo (JP)

( * ) Notice: Subject to any disclaimer, the term of this patent is extended or adjusted under 35 U.S.C. 154(b) by 990 days.

(21) Appl. No.: 12/298,991

(22) PCT Filed: Apr. 27, 2007

(86) PCT No.: PCT/JP2007/059559

§ 371 (c)(1),
(2), (4) Date: Mar. 11, 2009

(87) PCT Pub. No.: WO2007/129720

PCT Pub. Date: Nov. 15, 2007

(65) Prior Publication Data

US 2009/0221457 A1 Sep. 3, 2009

(30) Foreign Application Priority Data

May 2, 2006 (JP) ..... 2006-128381

(51) Int. Cl.

| | |
|---|---|
| ***C10M 133/20*** | (2006.01) |
| ***C10M 137/06*** | (2006.01) |
| ***C10M 129/40*** | (2006.01) |
| ***C10M 141/02*** | (2006.01) |
| ***C10M 169/06*** | (2006.01) |

(52) U.S. Cl.

CPC ..... *C10M 169/06* (2013.01); *C10M 2207/126* (2013.01); *C10M 2207/1285* (2013.01);

(Continued)

(58) Field of Classification Search

USPC ..... 508/162, 539, 552, 528

See application file for complete search history.

(56) References Cited

U.S. PATENT DOCUMENTS 4,675,121 A * 6/1987 Root et al. ..... 508/147
4,787,992 A * 11/1988 Waynick ..... 508/163

(Continued)

FOREIGN PATENT DOCUMENTS

DE 1644908 B * 8/1972
GB 1230106 4/1967

(Continued)

OTHER PUBLICATIONS

Machine translation of the claims of DE 1644908. The reference has previously been supplied.*

(Continued)

*Primary Examiner* — James Goloboy

(74) *Attorney, Agent, or Firm* — Howard & Howard Attorneys PLLC

(57) ABSTRACT

A lubricating grease composition comprising (A) a base oil, (B) 5 to 10 wt. % of a urea compound, (C) 0.5 to 20 wt. % of at least one phosphorous compound selected from the group consisting of a phosphoric acid salt etc., and (D) 0.5 to 40 wt. % of a fatty acid metal salt. Aforementioned lubricating grease composition allows it to reduce the friction coefficient and prolong the endurance life significantly when it is applied onto surfaces of the sliding pair consisting of metal and plastic (especially glass-fiber-reinforced plastic) parts.

13 Claims, 1 Drawing Sheet

Hollow cylindrical specimen

(52) U.S. Cl.
CPC ..... *C10M 2207/124* (2013.01); *C10M 2207/2835* (2013.01); *C10M 2201/0856* (2013.01); *C10M 2213/0626* (2013.01); *C10M 141/02* (2013.01); *C10M 2201/085* (2013.01); *C10M 2207/1265* (2013.01); *C10M 2207/12* (2013.01); *C10M 2207/1206* (2013.01); *C10M 2207/128* (2013.01); *C10M 2207/106* (2013.01); *C10M 2207/2895* (2013.01); *C10N 2210/01* (2013.01); *C10M 2229/0425* (2013.01); *C10M 2207/10* (2013.01); *C10N 2240/02* (2013.01); *C10N 2210/02* (2013.01); *C10M 2205/0285* (2013.01); *C10M 2215/1026* (2013.01); *C10N 2210/03* (2013.01); *C10M 2207/1245* (2013.01); *C10M 2213/062* (2013.01); *C10M 2229/0415* (2013.01); *C10N 2250/10* (2013.01); *C10M 2209/1033* (2013.01); *C10N 2230/06* (2013.01)
USPC ..... 508/162; 508/528; 508/539

(56) References Cited

U.S. PATENT DOCUMENTS

| | | | | |
|---|---|---|---|---|
| 5,084,193 | A | 1/1992 | Waynick | |
| 5,096,605 | A * | 3/1992 | Waynick | 508/163 |
| 5,102,565 | A | 4/1992 | Waynick | |
| 2003/0087768 | A1 | 5/2003 | Florchinger et al. | |

FOREIGN PATENT DOCUMENTS

| | | | |
|---|---|---|---|
| GB | 1230106 | A * | 4/1971 |
| JP | 63039989 | A | 2/1988 |
| JP | 64026698 | A | 1/1989 |
| JP | 04041714 | A | 2/1992 |
| JP | 08157859 | A | 6/1996 |
| JP | 11336779 | A * | 12/1999 |
| JP | 2001089778 | A | 4/2001 |

OTHER PUBLICATIONS

English language abstract for JP 63039989 extracted from espacenet.com database, dated Apr. 20, 2009.

English language abstract for JP 64026698 extracted from PAJ database, dated Apr. 20, 2009.

English language abstract for JP 04041714 extracted from PAJ database, dated Apr. 20, 2009.

English language translation and abstract for JP 08157859 extracted from PAJ database, dated Apr. 20, 2009, 48 pages.

English language translation and abstract for JP2001089778 extracted from PAJ database, dated Apr. 20, 2009, 22 pages.

PCT International Search Report for PCT/JP2007/059559, dated Aug. 3, 2007, 4 pages.

English language abstract and machine assisted translation for JPH11336779 extracted from PAJ database on Apr. 1, 2014, 21 pages.

* cited by examiner

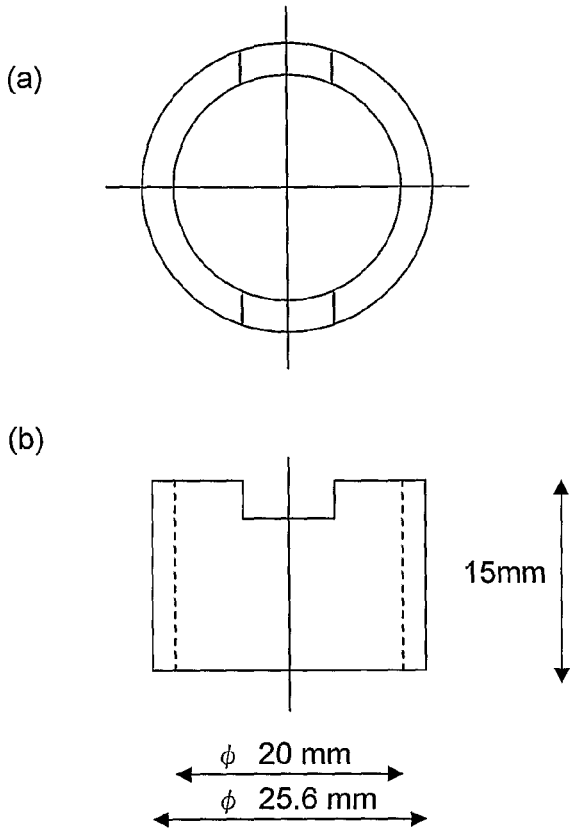
Hollow cylindrical specimen

LUBRICATING GREASE COMPOSITION

RELATED APPLICATIONS

This application claims priority to and all the advantages of International Patent Application No. PCT/JP2007/059559, filed on Apr. 27, 2007, which claims priority to Japanese Patent Application No. JP2006-128381, filed on May 2, 2006.

TECHNICAL FIELD

The present invention relates to a lubricating grease composition, and more specifically, to a lubricating grease composition which, when applied between the sliding pairs made of metal and plastic and/or between metal parts, produces excellent lubricating properties between these sliding pairs. In particular, the invention relates to a lubricating grease composition giving excellent lubricating properties between sliding pairs made of a metal part and a glass-fiber-reinforced plastic part.

BACKGROUND ART

In the area of automobile parts, domestic electric appliances, office automation devices, audio-video equipment, a industrial trend is observed to replace metal parts, e.g., such parts as metal gears or the like, and especially sliding parts, with plastic ones toward weight reduction of aforementioned commodities or toward its cost reduction. Examples of such replacements are combinations of plastic gears and metal gears used in reduction gears associated with wiper motors or electric power assisted steering units contained in steering mechanisms of vehicles. On the other hand, loads and sliding speeds of such mechanisms are increasing with a trend of miniaturization, and sliding conditions are getting severe toward higher transmission efficiency. For such industrial trend, the required performance of the lubricating grease composition is becoming higher and it is getting more difficult to accomplish its low friction property and durability enough to satisfy such required performance. Thus, it was proposed to use grease compositions that contain specific finely powdered polytetrafluoroethylene. The proposed composition is formed into a lubricating film between the interacting parts, and will restrain the wear of parts and improve the endurance life of the sliding parts even under the aforementioned stringent condition (see Patent Reference 1).

It should be noted that glass-fiber-reinforced plastics, such as glass-fiber-reinforced polyamides or other organic resins, possess excellent tensile strength, flexural modulus of elasticity, and other mechanical properties, and satisfy the aforementioned required performance for increase in loads and sliding speeds of such sliding plastic parts. However, even though the reinforced plastic parts are superior in mechanical strength to plastic parts without reinforcement, they are insufficient in long-term performance, and even the use of conventional grease compositions cannot protect these materials from degradation of its mechanical strength properties along time.

Patent Reference 2 and Patent Reference 3 disclose lubricating grease compositions which contain polyurea and calcium soap as thickeners, as well as tricalcium phosphate and calcium carbonate as extreme-pressure wear-resistant additives. Patent Reference 4 discloses a lubricating grease composition which contains tricalcium phosphate and mineral oil compound, and Patent Reference 5 discloses a lubricating grease composition which contains tricalcium phosphate and urea compound as a thickeners. Although such lubricating grease compositions show excellent performance applied for metal-to-metal pairs, they are insufficient to improve the sliding performance of plastic parts. More specifically, they do not show sufficient performance to improve the sliding properties of parts made of glass-fiber-reinforced plastics. And when the sliding pair is consisting of metal parts and such plastic parts (especially, glass-fiber-reinforced ones) noticeably damages the sliding surfaces on the metal counterparts. Aforementioned lubricating grease compositions of Patent references are insufficient to solve the above-described problems.

[Patent Reference 1] Japanese Unexamined Patent Application Publication (Kokai) 2001-89778
[Patent Reference 2] Kokai S64-26698
[Patent Reference 3] Kokai H04-41714
[Patent Reference 4] Kokai H04-65119
[Patent Reference 5] Kokai H08-157859 (equivalent to U.S. Pat. No. 4,743,671)

DISCLOSURE OF INVENTION

It is an object of the present invention to provide a lubricating grease composition that can reduce friction coefficient on lubricated parts and prolong its endurance time of these parts even if they are using under aforementioned sever conditions. It is another object of the invention to provide a lubricating grease composition which, when applied onto surfaces of the sliding pair consisting of metal and plastic (especially glass-fiber-reinforced plastic) parts, reduces friction coefficient on lubricated parts and prolong its endurance time of these parts.

After a study to solve the aforementioned problems, the inventors found that such problems can be solved by using a lubricating grease composition comprising at least one phosphorous compound selected from the group consisting of a phosphoric acid salt, a metaphosphoric acid salt, a diphosphoric acid salt (pyrophosphate), a triphosphoric acid salt (tripolyphosphate), a phosphorous acid salt, a diphosphorous acid salt, or a hypophosphorous acid salt, and a fatty acid metal salt.

Furthermore, the inventors found that these problems can be solved by using a lubricating grease composition comprising the following components: (A) a base oil; (B) 5 to 10 wt. % of a urea compound; (C) 0.5 to 20 wt. % of at least one phosphorous compound selected from the group consisting of a phosphoric acid salt, a metaphosphoric acid salt, a diphosphoric acid salt (pyrophosphate), a triphosphoric acid salt (tripolyphosphate), a phosphorous acid salt, a diphosphorous acid salt, and a hypophosphorous acid salt; and (D) 0.5 to 40 wt. % of a fatty acid metal salt. These findings also brought the inventors to the present invention.

DETAILED DESCRIPTION OF THE INVENTION

The present invention specifically relates to the following:

[1] A lubricating grease composition comprising
- at least one phosphorous compound selected from the group consisting of a phosphoric acid salt, a metaphosphoric acid salt, a diphosphoric acid salt (pyrophosphate), a triphosphoric acid salt (tripolyphosphate), a phosphorous acid salt, a diphosphorous acid salt, and a hypophosphorous acid salt;
- and a fatty acid metal salt.

[2] A lubricating grease composition comprising
- (A) a base oil;
- (B) 5 to 10 wt. % of a urea compound;

(C) 0.5 to 20 wt. % of at least one phosphorous compound selected from the group consisting of a phosphoric acid salt, a metaphosphoric acid salt, a diphosphoric acid salt (pyrophosphate), a triphosphoric acid salt (tripolyphosphate), a phosphorous acid salt, a diphosphorous acid salt, and a hypophosphorous acid salt; and (D) 0.5 to 40 wt. % of a fatty acid metal salt.

[3] The lubricating grease composition of items [1] or [2], wherein the aforementioned fatty acid metal salt is one or more types of metal salt of hydroxymonocarboxylic fatty acids, or monocarboxylic fatty acids having 8 to 22 carbon atoms, and the fatty acid metal salt comprise one or more metal selected from the group consisting of lithium, magnesium, sodium, or aluminum.

[4] The lubricating grease composition of items [1] or [2], wherein the phosphorous compound is a powdered zinc pyrophosphate and/or a tricalcium phosphate.

[5] The lubricating grease composition of items [1] or [2], wherein the aforementioned fatty acid metal salt is one or more types of metal salt of a stearic acid or a hydroxystearic acid, and the fatty acid metal salt comprise one or more metal selected from the group consisting of lithium, magnesium, sodium, or aluminum.

[6] Use of the lubricating grease composition of items [1] to [5]
for lubricating friction pair comprising plastic parts.

[7] Use of the lubricating grease composition of items [1] to [5]
for lubricating friction pair comprising glass-fiber-reinforced plastic parts.

[8] Use of the lubricating grease composition of items [1] to [5]
for lubricating friction pair comprising plastic and metal parts.

[9] Use of the lubricating grease composition of items [1] to [8]
for lubricating friction pair in vehicles.

The lubricating grease composition provided by this invention allows it to reduce friction coefficient on lubricated parts and prolong its endurance time of these parts even if they are using under severe conditions. Furthermore, the lubricating grease composition of this invention allows it possible to provide a lubricating grease composition which, when applied onto surfaces of the sliding pair consisting of metal and plastic (especially glass-fiber-reinforced plastic) parts, reduces friction coefficient on lubricated parts and prolong its endurance time of these parts.

BEST MODE FOR CARRYING OUT THE INVENTION

(A) Base Oil

There are no special restrictions with regard to a base oil used in the grease composition of the present invention, and the base oils is not particularly limited in kind. Examples thereof include a paraffin-type mineral oil, a diester, a polyolester, or a similar ester-type synthetic oil; a poly-α-olefin, a co-oligomer of ethylene and α-olefin, a polybutene, or a similar synthetic hydrocarbon oil; an alkylene diphenyl ether, a polyalkylene ether, or a similar ether-type synthetic oil; a diester and a polyol ester, or a similar ester-type oil; and a polydimethyl silicone, a polymethylphenyl silicone, or a similar silicone oil. Most preferable of the above oils are synthetic hydrocarbon oils, which can reduce transmission of impacts to plastic parts, possess excellent heat-resistant properties, produce low-temperature balance, and protect the plastic materials from stress cracking. Polyalkylene ether, polyol ether, and polymethylphenyl silicone are also suitable for protecting plastic materials from stress cracking. These base oils may be used in combination of two or more. It is further preferable that dynamic viscosity of the base oil of one or more types is in the range of 5 to 500 $mm^2/s$ at 40° C.

(B) Urea Compound

An urea compound contained in the lubricating grease composition of the present invention is used as a thickener of the base oil. This component is recommended for giving excellent resistance to deterioration by oxidation under high-temperature and prolonging its endurance time of lubricated parts, including those made from plastics. Specific examples of the aforementioned urea compound are the following: di-urea compounds, tri-urea compounds, and tetra-urea compounds, poly-urea compounds (except for said di-urea compounds, tri-urea compounds, tetra-urea compounds), or similar urea compounds; and urea-urethane compounds, diurethane compounds, or other urethane compounds or mixtures of the aforementioned compounds. It is preferable to use di-urea compounds, urea-urethane compounds, diurethane compounds, or mixtures of the above compounds.

Most preferable urea compounds may comprise diurethane compounds, urea-urethane compounds, and di-urea compounds represented by the following formula (1):

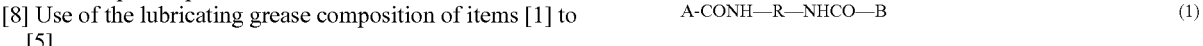

A-CONH—R—NHCO—B (1)

where A and B may be the same or different and individually designate groups represented by the following formulae: —$NHR^1$, —$NR^2R^3$ or —$OR^4$, where $R^1$, $R^2$, $R^3$, and $R^4$ may be the same or different and individually designate hydrocarbon groups having 6 to 20 carbon atoms. The hydrocarbon groups designated by $R^1$, $R^2$, $R^3$, and $R^4$ may be represented, e.g., by alkyl groups with 6 to 20 carbon atoms having linear or branched molecular structures, alkenyl groups having linear or branched molecular structures, cycloalkyl groups, alkylcycloalkyl groups, aryl groups, alkylaryl groups, arylalkyl groups, etc. Preferable ones are linear or branched alkyl groups with 6 to 20 carbon atoms, cycloalkyl groups, or alkylaryl groups, and most preferable are octadecyl groups, cyclohexenyl groups, or toluoyl groups.

In aforementioned formula (1), R designate a bivalent hydrocarbon group. Such a bivalent hydrocarbon group is exemplified by a linear or branched alkylene group, linear or branched alkenylene group, a cycloalkylene group, an arylene group, an alkylarylene group, an arylalkylene group, etc. It is recommended that the bivalent hydrocarbon group designated by R contains 6 to 20 carbon atoms, preferably 6 to 15 carbon atoms.

Specific examples of bivalent hydrocarbon groups designated by R are the following: ethylene group, 2,2-dimethyl-4-methylhexylene group, or groups represented by the following formulae (2) to (11), of which the bivalent hydrocarbon groups represented by the formulae (3) and the formulae (5) are most preferable.

(2)

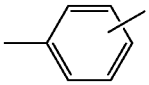

-continued (3)

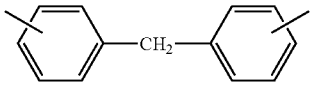

(4)

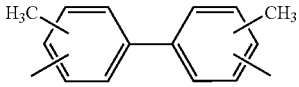

(5)

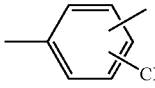

(6)

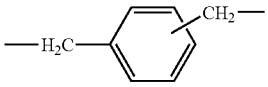

(7)

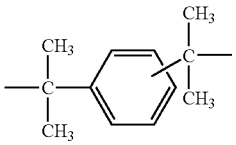

(8)

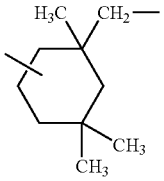

(9)

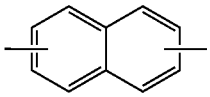

(10)

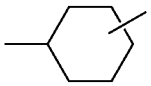

(11)

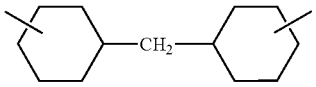

The urea compound represented by formula (1) can be obtained by reacting diisocyanate represented by formulae OCN—R—NCO with a compound represented by the following formulae $R^1NH_2$, $R^2R^3NH$, and $R^4OH$, or a mixture thereof, in a base oil at a temperature of 100° C. to 200° C. Wherein, $R^1$, $R^2$, $R^3$, and $R^4$ designate as the same groups defined as above.

The amount of the urea compound contained in the lubricating grease composition of the invention may be arbitrary. And, it is preferable to contain the urea compound in an amount of 0 to 20 wt. % to total amount of the lubricating grease composition. However, for specifically prolonging endurance life of lubricated plastic parts (especially of parts made from a glass-fiber-reinforced plastics), it is recommended to contain the urea compound in an amount of 5 to 10 wt. %. If the urea compounds are used in an amount exceeding the recommended upper limit, the lubricating grease composition may become too hard and may not give a sufficient lubricating capacity.

The lubricating grease composition of this invention is characterized by containing at least one phosphorous compound (C) selected from the group consisting of a phosphoric acid salt, a metaphosphoric acid salt, a diphosphoric acid salt (pyrophosphate), a triphosphoric acid salt (tripolyphosphate), a phosphorous acid salt, a diphosphorous acid salt, or a hypophosphorous acid salt, and a fatty acid metal salt (D) having 8 to 24 carbon atoms. And, the lubricating grease composition provided by this invention allows it to reduce friction coefficient on lubricated parts made from plastic (especially from glass-fiber-reinforced plastic) and prolong its endurance time of these parts.

The aforementioned component (C) is recommended to be contained in an amount of 0.5 to 20 wt. %, and component (D) in an amount of 0.5 to 40 wt. % to total amount of the lubricating grease composition. More preferably, Component (C) is contained in an amount of 1 to 15 wt. %, and component (D) in an amount of 1 to 30 wt. %. Such lubricating grease composition containing aforementioned components (C) and (D) allows it to reduce friction coefficient on lubricated parts and prolong its endurance time of these parts even if they are using under severe conditions. Furthermore, the lubricating grease composition of this invention allows it possible to provide a lubricating grease composition which, when applied onto surfaces of the sliding pair consisting of metal and plastic (especially glass-fiber-reinforced plastic) parts, reduces friction coefficient on lubricated parts and prolong its endurance time of these parts. A more detailed description of components (C) and (D) is given as below.

The component (C) is at least one phosphorous compound selected from the group consisting of a phosphoric acid salt, metaphosphoric acid salt, diphosphoric acid salt (pyrophosphate), triphosphoric acid salt (tripolyphosphate), phosphorous acid salt, diphosphorous acid salt and a hypophosphorous acid salt. Adding such component (C) with component (D) to the lubricating grease composition imparts to the composition functions of a solid lubricating agent and thus prolongs the effects of decreasing friction coefficient on lubricated parts and extending its endurance time A specific example of a phosphoric acid salt is a metal salt having a counter anion represented by $PO_4^{3-}$. Preferable salts are represented by the following formulae: $Na_3PO_4$, $Ca_3(PO_4)_2$, $AlPO_4$, $Zn_3(PO_4)_2$, $FePO_4$, $Fe_3(PO_4)_2$, $Sn_3(PO_4)_2$, $Pb_3(PO_4)_2$, etc. The phosphoric acid salts is not particularly limited in kind exemplified as above in the invention. Specific examples of methaphosphoric acid salts are metal salts having counter anion represented by $PO^{3-}$, $P_3O_9^{3-}$, $P_4O_{12}^{4-}$ or similar metal salts. Most preferable are $(NaPO_3)_n$, $K_3P_3O_9$, $K_2Na_2(P_4O_{12})$, etc. However, the methaphosphoric acid salts are not particularly limited in kind exemplified as above in this invention. A specific example of a diphosphoric acid salt (pyrophosphate) is a metal salt having a counter anion represented by $P_2O_7^{4-}$. Most preferable are the following pyrophosphates: $Ca_2P_2O_7$, $Pb_2P_2O_7$, $Fe_4(P_2O_7)_3$, $Zn_2P_2O_7$, $Sn_2P_2O_7$, etc. However, the diphosphoric acid salts are not particularly limited in kind exemplified as above in this invention. A specific example of a triphosphoric acid salt (tripolyphosphate) is a metal salt having a counter anion represented by $P_3O_{10}^{5-}$. Most preferable are the following tripolyphosphates: $Zn_5(P_3O_{10})$, $Na_5P_3O_{10}$, etc. However, the triphosphoric acid salts are not particularly limited in kind exemplified as above in this invention. Phosphorous acid salts can be exemplified by a metal salt having a counter anion represented by $PHO^{2-}$. Most preferable are phosphorous acid salts of the following formulae: $ZnHPO_3$, $PbHPO_3$, etc. However, the phosphorous acid salts are not particularly limited in kind exemplified as above in this invention. Diphosphorous acid salts (pyrophosphites) can be exemplified by a metal salt having a counter anion represented by $P_2H_2O_5^{2-}$. Most preferable is $Na_2P_2H_2O_5$. However, the possible pyrophosphites is not limited by this compound. Hypophosphorous acid salts can be exemplified by a metal salt having a counter anion represented by $PH_2O_2^-$. Most preferable is $NaPH_2O_2$, or the like. However, the possible hypophosphorous acid salt is not limited by these compounds. In order to provide more uniform dispersion in the lubricating grease composition and prolong the effective period of reducing the friction coefficient on the lubricated parts, it is recommended that component (C) be used in a powdered form, especially in the finely powdered form. Phosphorous compounds are more preferable for use as component (C) in a finely powdered form, and most preferable ones are exemplified as the following: a zinc pyrophosphate of formula $Zn_2P_2O_7$, a tricalcium phosphate of formula $Ca_3(PO_4)_2$, and an aluminum phosphate $AlPO_4$. These compounds may be used individually or in combinations.

It is recommended that component (C) be contained in the lubricating grease composition in an amount of 0.5 to 20 wt. %, preferably 1 to 15 wt. %, and most preferably 2 to 10 wt. %. If component (C) is used in an amount below the lower recommended limit, then even mixing with component (D), may not may not give a sufficient lubricating capacity. Addition of component (C) in an amount exceeding the upper recommended limit may not improve the effect but rather makes the obtained grease harder and less efficient in use of this invention.

Component (D) is a metal salt of a fatty acid. The component has its function of a thickener to base oils. In this invention, the combination of this component with component (C) allows it possible to reduce friction coefficient on lubricated parts for a long term and prolong its endurance time significantly. Especially, such combination of components (C) and (D) in the grease composition prolong its endurance time of lubricated parts consisting of metal and plastic (especially glass-fiber-reinforced plastic) parts and easy to be heated by friction. Furthermore, component (D) is a basic-oil thickener. However, in order to prevent the decrease of the dropping point of the grease composition, it is recommended to use component (B) as a basic-oil thickener together.

Specific examples of metal salts of fatty acids are metal salts of monocarboxylic fatty acids or hydroxymonocarboxylic fatty acids, as well as metal salts of fatty acids derived from animal oils or from vegetable oil, e.g., a seed oil, which are used in the production of metal soaps. Preferable are metal salts of monocarboxylic fatty acids or hydroxymonocarboxylic fatty acids, especially metal salts of the aforementioned fatty acids having 8 to 22 carbon atoms. The following are specific examples of the above metal salts of monocarboxylic fatty acids: metal salts of a lauric acid, myristic acid, palmitic acid, stearic acid, behenic acid, myristoleic acid, palmitoleic acid, oleic acid, or a linoleic aid. The following are specific examples of metals salts of hydroxymonocarboxylic acids: metal salts of 12-hydroxystearic acid, 14-hydroxystearic acid, 16-hydroxystearic acid, 6-hydroxystearic acid, or 9,10-hydroxystearic acid. The aforementioned metal salts of fatty acids may comprise metal salts of one or more types selected from the fatty acid salts of lithium, zinc, magnesium, sodium, or aluminum. From the viewpoint of more efficient improvement in endurance time of the lubricated parts made from metals and plastics (especially glass-fiber-reinforced plastics), it is recommended to use metal salts, especially lithium salts, of linear-chain monocarboxylic fatty acids or linear-chain hydroxymonocarboxylic fatty acids. Most preferable metal salts are lithium stearate and lithium 12-hydroxystearate.

It is recommended that aforementioned component (D) be contained in an amount of 0.5 wt. % to 40 wt. %, preferably 1 to 30 wt % to the total amount of the grease composition of this invention. If component (D) is used in an amount less than the lower recommended limit, the effect of this invention may be insignificant, even if this component is used in combination with component (C). The use of component (D) in an amount exceeding the recommended upper limit may not give a desired effect, but rather may increase viscosity of the lubricating grease composition and it is getting difficult to spread of this lubricant over the surfaces of the said parts.

If necessary, the lubricating grease composition of the invention can be combined with conventionally used additives. Such additives may comprise, e.g., antioxidants, extreme-pressure agents, anti-rust agents, anticorrosive inhibitors, metal deactivators, dyes, color stabilizer, thickeners, structural stabilizers, etc.

The lubricating grease composition of this invention can be prepared by mixing aforementioned components (A) to (D). If necessary, the lubricating grease composition can be prepared by adding phosphoric acid metal salts, fatty acid metal salts, or other additives to the basic grease, and stirring and mixing all the components. If necessary, the lubricating grease composition can be finished by passing the mixture through a roll mill, or the like. When the basic grease contains metal salts of fatty acids, the composition can be prepared only by mixing the basic grease with metal salts of the phosphoric acid and then passing through a roll mill, or the like. The most preferable method of preparation of this composition is mixing a basic grease that contains a urea compound (B) as a thickener to the base oil (A) with a metal salt of a phosphoric acid, metal salt of an aliphatic acid, and other additives, and then finishing by the treatment with a roll mill. In addition, there is another method suitable for the preparation of the lubricating grease composition of the invention. The preparation method consists of premixing base oil (A) of the lubricating grease composition with raw materials of urea compound (B). By melting and stirring the aforementioned pre-mixture, urea compound (B) is prepared as a dispersed form in the base oil, then a phosphoric-acid metal salt, fatty-acid metal salt, and other additives are added to the base oil, and all components are stirred and finished by passing the obtained mixture through a roll mill.

The lubricating grease composition of this invention forms lubricating films on the surfaces of parts made from metals, plastics, ceramics, or other materials. These lubricating films significantly improve endurance life of plastic parts, especially of parts made from glass-fiber-reinforced plastics. Moreover, when the lubricating grease composition of the invention is applied onto friction pair comprising metal and plastic parts, it forms a long-lasting lubricating film which is able to extend these endurance lives of the respective parts, especially if the sliding pair consists of a metal part and a glass-fiber-reinforced plastic part. Conventional lubricating grease compositions with EP (i.e. extreme-pressure) additives (e.g., those are proposed in references 3 to 5) are able to create strong lubricating films under the effect of friction-generated heat and thus to restrain the wear and deterioration of metal-to-metal pairs participating in sliding motion.

However, these lubricating greases containing EP additive do not provide sufficient lubricating property when those greases are applied onto the friction pair comprising plastic part (especially, glass-fiber-reinforced plastic part with excellent heat-radiating property) and metal parts, because its surface temperature is not risen enough to form a lubricating film onto the friction pair by friction heating. Unlike the conventional lubricating greases, the lubricating grease of the present invention is capable to form effective lubricating film even onto the surface of a metal-plastic friction pair, especially onto the surface of a friction pair comprising a metal part and a glass-fiber-reinforced plastic part with excellent heat-radiating properties. This lubricating grease allows it possible to restrict abrasive wear and deterioration of the metal part and prolong its endurance life.

Plastic materials suitable for lubricating with the grease composition of the present invention are all conventional plastics and engineering plastics, especially those which can be reinforced with glass fibers. Examples of such plastics are the following: polyethylene (PE), polypropylene (PP), ABS resin (ABS), phenol resin (PF), epoxy resin (EP), polyacetal (POM), nylon (PA), polycarbonate (PC), polyethylene terephthalate (PET), polybutylene terephthalate (PBT), polyphenylene sulfide (PPS), polyimide (PI), polyether ether ketone (PEEK), etc.

The aforementioned lubricating grease composition is characterized by a excellent friction reduction effect, which is maintained at a high level over a long period of time. Therefore the grease of the invention is especially suitable for use as a grease for lubricating uniform-speed gears and variable-speed gears, as a grease for lubricating ball bearings, roller bearings, etc, and as a grease for lubricating bearings of vehicles, railroad cars, etc. In particular, the lubricating grease of the invention is applicable for use in vehicles for lubricating parts of electrically-driven power-assist steering (EPS) mechanisms, wiper motors, window regulators or similar mechanism that contain friction pairs consisting of metal worm gears and wheel gears comprising glass-fiber-reinforced plastic parts and metal parts.

Examples

The invention will be further described with reference to practical examples and comparative examples. It is understood, however, that the invention is not limited by the aforementioned practical examples.

[Method for Evaluating Lubricating Grease Compositions (Used for Lubricating Sliding Pair Consisting of Metal and Plastic Parts): Evaluation by Means of Suzuki-Type Tester (1)]

Specimens were prepared from steel S45C (hereinafter referred to as S45C specimens) and 30% glass-reinforced Nylon (hereinafter referred to as PA46GF30 specimens) in the form of hollow cylindrical bodies (FIG. 1) having an inner diameter of 20 mm, an outer diameter of 25.6 mm, and a height of 15 mm.

A pair consisting of the PA46GF30 specimen and the S45C specimen coated with about 0.1 g of the lubricating grease composition was tested for 120 min. at a 20 MPa load and 100 mm/s sliding speed. Endurance life test was carried out until the temperature at a depth of about 1 mm from the sliding surface of the S45C specimen reached 160° C., or when seizure caused by extraordinary friction force was observed on the sliding surfaces. When the test time exceeded 120 min., the maximum temperature was registered at the moment. During the test, the coefficient of friction was registered in the most stable part of the specimen.

[Evaluation of the Lubricating Grease Composition (Case of Metal-to-Metal Pair): Evaluation by Means of Suzuki-Type Tester (2)]

A pair consisting of the S45C specimens coated with about 0.1 g of the lubricating grease composition was tested for 120 min. at a 20 MPa load and 100 mm/s sliding speed. Endurance life (min.) was registered at the moment when the tester was stopped by a torque control function of the machine. The maximum temperature (° C.) was measured at a depth of about 1 mm from the sliding surface of the S45C specimen. Also, the time X (min) was evaluated as the time passed from the initiation of the test until seizure occurred on the specimens [hereinafter referred to as "Seizure after X min".]. When seizure occurred directly at the moment of initiation of the test, the maximum temperature (° C.) was marked as "non-measurable".

Practical Examples 1 to 6, Comparative Example 1, Comparative Example 2

Base greases composed of base oils and fatty acid metal salts (thickeners) shown in Table 1 were combined with various additives shown in Table 1, and the components were then stirred and passed through a three-roll mill to prepare a Japanese "tyo-do No.2" (=consistency No. 2) grade lubricating grease composition (except for the lubricating grease compositions of Comparative 1 which consisted of the base grease itself, not containing any additives). The tests were conducted by the methods described above with the use of S45C specimens and PA46GF30 specimens. Coefficients of friction developed on the sliding parts with the use of the obtained compositions, the endurance life (min.), and the maximum temperatures (° C.) were evaluated. The results are shown in Table 1.

Practical Examples 7 to 14, Comparative Example 3 to 5

The poly-α-olefin (viscosity at 40° C.: 47 $mm^2/s$) was used as common base oil. A half weight of the base oil and an amine mixture (cyclohexylamine and stearylamine mixed in a 8:2 mole ratio) were loaded into a reactor to form a mixture (1), which was then heated to a temperature in the range of 70 to 80° C. On the other hand, another mixture (2) was prepared from the other half weight of the base oil and a diphenylmethane diisocyanate. This mixture (2) was loaded to another reactor, heated to a temperature of 70° C. to 80° C., and stirred. The temperature of this mixture was risen under the effect of the exothermic heat of the reaction, and the heated mixture was stirred under this condition for 30 min., then the temperature was further reached to the range of 170 to 180° C., and the content was maintained at this temperature for 30 min. As a result, a diurea compound was synthesized in the poly-α-olefin. The reaction mixture was cooled, combined with various additives shown in Table 2, stirred, and then passed through a three-roll mill. As a result, a Japanese "tyo-do No.2" (=consistency No. 2) grade lubricating grease composition (except for the lubricating grease compositions of Comparative 3 which consisted of the base grease itself, not containing any additives) was prepared. The tests were conducted by the methods described above with the use of S45C specimens and PA46GF30 specimens. Coefficients of friction developed on the sliding parts with the use of the obtained compositions, the endurance life (min.), and the maximum temperatures (° C.) were evaluated. The results are shown in Table 2.

Practical Examples 15 and 16

Japanese "tyo-do No.2" (=consistency No. 2) grade lubricating grease compositions were prepared by the same method as in said [Practical Examples 1 to 6 and Comparative Examples 1 and 2] by adding various additives shown in Table 3 to basic greases composed of base oils and fatty acid metal salts (thickeners) shown in Table 3, stirring and passing through a three-roll mill. The obtained lubricating greases were applied onto the surfaces of S45C specimens (i.e. a metal-to-metal sliding pair), and then the endurance life (min.) of the lubricating grease and the maximum temperature (° C.) were evaluated. The results are shown in Table 3.

Practical Example 17 and Comparative Examples 6 and 7

Similar to Practical Examples 7 to 14 and Comparative Examples 3 to 5, a diurea compound was synthesized in a poly-α-olefin. After the reaction mixture was cooled, it was combined with various additives shown in Table 3, the mixture was then stirred and passed through a three-roll mill to prepare a Japanese "tyo-do No.2" (=consistency No. 2) grade lubricating grease composition (except for the lubricating grease compositions of Comparative 6 which consisted of the base grease itself, not containing any additives). The tests were conducted by the methods described above with the use of S45C specimens as sliding pair. The endurance life (min.) of the lubricating grease compositions and the maximum temperatures (° C.) were evaluated. The results are shown in Table 3.

TABLE 3-continued

| | Practical Examples | | | Comparative Examples | |
|---|---|---|---|---|---|
| | 15 | 16 | 17 | 6 | 7 |
| Maximum temperature (° C.) | 89 | 88 | 95 | Non-measurable | 96 |

*Time marked until the moment when the test was stopped under a torque control function of the tester.

Abbreviations used in Tables 1 to 3 have the following meanings:

PAO: poly-α-olefin (viscosity at 40° C.: 68 $mm^2/s$)

$PAO^U$: poly-α-olefin (with urea-type thickener) (viscosity at 40° C.: 47 $mm^2/s$)

PAE: polyalkylene ether (viscosity at 40° C.: 105 $mm^2/s$)

POE: polyol ester (viscosity at 40° C.: 52 $mm^2/s$)

PMPS: polymethylphenyl silicone (viscosity at 40° C.: 70 $mm^2/s$)

St-Li: lithium stearate

TABLE 1

| | Practical Examples | | | | | | Comparative Examples | |
|---|---|---|---|---|---|---|---|---|
| | 1 | 2 | 3 | 4 | 5 | 6 | 1 | 2 |
| Base oil | PAO | PAO | PAO | PAE | POE | PMPS | PAO | PAO |
| Thickener | St-Li 9.1% | St-Li 9.1% | St-Li 7.8% | 120H—Li 8.0% | 120H—Li 7.6% | St-Li 17.5% | St-Li 10.5% | St-Li 7.8% |
| Additive 1 | PP_Zn 5.0% | P_Ca 5.0% | PP_Zn 5.0% | PP_Zn 5.0% | PP_Zn 5.0% | PP_Zn 5.0% | — | PTFE 5.0% |
| Additive 2 | — | — | St-Li 5.0% | St-Li 5.0% | St-Li 5.0% | St-Li 5.0% | — | — |
| Coef. of friction | 0.025 | 0.024 | 0.022 | v0.025 | 0.026 | v0.021 | 0.082 | 0.049 |
| Endurance life (min) | >120 | >120 | >120 | 87 | 82 | >120 | 2 | 3 |
| Maximum temperature (° C.) | 145 | 141 | 121 | 160 | 160 | 131 | 160 | 160 |

TABLE 2

| | Practical Examples | | | | | | | | Comparative Examples | | |
|---|---|---|---|---|---|---|---|---|---|---|---|
| | 7 | 8 | 9 | 10 | 11 | 12 | 13 | 14 | 3 | 4 | 5 |
| Base oil | $PAO^U$ | | | | | | | | | | |
| Thickener | Urea Compound | | | | | | | | | | |
| Additive 1 | PP_Zn 1.0% | PP_Zn 5.0% | PP_Zn 15.0% | PP_Zn 5.0% | PP_Zn 5.0% | PP_Zn 5.0% | PP_Zn 5.0% | PP_Zn 5.0% | — | PP_Zn 5.0% | — |
| Additive 2 | St-Li 1.0% | St-Li 5.0% | St-Li 15.0% | St-Ca 1.0% | St-Zn 5.0% | St-Mg 5.0% | St-Na 5.0% | St-Al 5.0% | — | — | St-Li 5.0% |
| Coef. of friction | 0.024 | 0.022 | 0.022 | 0.024 | 0.022 | 0.024 | 0.024 | 0.023 | 0.049 | 0.025 | 0.040 |
| Endurance life (min) | 30 | >120 | >120 | >120 | >120 | >120 | >120 | >120 | 2 | 4.5 | 7.5 |

TABLE 3

| | Practical Examples | | | Comparative Examples | |
|---|---|---|---|---|---|
| | 15 | 16 | 17 | 6 | 7 |
| Base oil | PAO | | | $PAO^U$ | |
| Thickener | St-Li 9.1% | | | Urea Compound | |
| Additive 1 | PP_Zn 5.0% | PP_Zn 5.0% | PP_Zn 15.0% | PP_Zn 15.0% | PP_Zn 5.0% |
| Additive 2 | — | St-Li 5.0% | St-Li 15.0% | — | — |
| Endurance life* (min) | 30 | 41 | 36 | Seizure after 0 min. | Seizure after 4 min. |

12OH—Li: lithium 12-hydroxystearate

PP_Zn: zinc pyrophosphate

P_Ca: tricalcium phosphate

St_Ca: calcium stearate

St_Zn: zinc stearate

St_Mg: magnesium stearate

St_Na: sodium stearate

St_Al: aluminum stearate

PTFE: powdered polytetrafluoroethylene resin

[Results of Evaluation of Data Contained in Table 1]

In all cases where the lubricating grease compositions relating to Practical Examples 1 to 6 were used for lubricating sliding surface of a friction pair consisting of the S45C specimen (metal part) and the PA46GF30 specimen (glass-fiber-reinforced plastic), the coefficient of friction was reduced and did not exceed 0.03. In the Practical Examples 1 to 3 and 6, the endurance life was longer than 120 min. On the other hand, no decrease in the coefficient of friction was observed and the endurance life was limited by 2 min when the grease of Comparative Example 1, which did not include lithium stearate, was used as a lubricant. Even though the powdered polytetrafluoroethylene resin (PTFE), which is known as a solid lubricants used for decreasing the coefficient of friction, the grease of Comparative Example 2 containing PTFE in an amount of 5% improved neither the coefficient of friction nor the endurance life.

[Results of Evaluation of Data Contained of Table 2]

The lubricating grease compositions of Practical Examples 7 to 14 contain urea compounds as thickeners. When these grease compositions were used for lubricating sliding surfaces of a friction pair consisting of the S45C specimen (metal part) and PA46GF30 specimen (glass-fiber-reinforced plastic part), the coefficient of friction was reduced by less than 0.03, and the endurance life was longer than 120 min in Practical Examples 8 to 14.

On the other hand, in the case of the grease composition of Comparative Example 3 containing neither a phosphorous compound nor a fatty-acid-metal salt, the coefficient of friction was high, and the endurance life was no longer than 2 min. Also, in the case of Comparative Examples 4 and 5, the lubricating grease compositions contained only a phosphorous compound or only a fatty-acid-metal salt. Even though these additives were individually added, neither decrease in the coefficient of friction nor increase in the endurance life was observed.

[Results of Evaluation of Data Contained of Table 3]

In all case of the lubricating grease composition relating to Practical Examples 15 to 17, those were used as lubricants for S45C specimens (metal-to-metal pair), its endurance life was exceeding 30 min. In the aforementioned Practical Examples, no seizure was observed on the S45C specimens even when the test was discontinued by the tester. On the other hand, in the case of urea-thickened greases without additives (Comparative Example 6), seizure occurred in the very beginning and the test could not be continued. As follows from Comparative Example 7, which containing 5 wt. % zinc pyrophosphate alone to the urea-thickened grease, also did not allow completion of the test to the desired results since seizure occurred in 4 min. after beginning of the test.

BRIEF DESCRIPTION OF THE DRAWINGS

FIGS. 1(*a*) and 1(*b*) are respective top and side views of the specimen used for evaluation of the grease compositions on the Suzuki-type tester.

The invention claimed is:

1. A lubricating grease composition comprising
(A) a base oil,
(B) 5 to 10 wt. % of a urea compound,
(C) 1 to 20 wt. % of a zinc pyrophosphate, and
(D) 1 to 15 wt. % of a stearate metal salt.

2. The lubricating grease composition of claim 1 wherein the stearate metal salt comprises one or more metals selected from the group consisting of lithium, magnesium, sodium, and aluminum.

3. The lubricating grease composition of claim 1 wherein the zinc pyrophosphate is powdered.

4. The lubricating grease composition of claim 1 wherein the stearate metal salt is one or more types of metal salt of a stearic acid or a hydroxystearic acid, and the stearate metal salt comprises one or more metals selected from the group consisting of lithium, magnesium, sodium, and aluminum.

5. A method of lubricating a pair of sliding parts comprising a first part and a second part which are slidable relative to one another, said method comprising the step of applying a lubricating grease composition onto a surface of at least one of the first and second parts, wherein at least one of the first and second parts comprises a plastic part, wherein the lubricating grease composition comprises;
(A) a base oil,
(B) 5 to 10 wt. % of a urea compound,
(C) 1 to 20 wt. % of a zinc pyrophosphate, and
(D) 1 to 15 wt. % of a stearate metal salt.

6. A method as set forth in claim 5 wherein both the first and second parts comprise plastic parts.

7. A method as set forth in claim 5 wherein at least one of the first and second parts comprises a glass-fiber-reinforced plastic part.

8. A method as set forth in claim 5 wherein the first part comprises a plastic part and the second part comprises a metal part.

9. A method as set forth in claim 5 wherein the stearate metal salt comprises one or more metals selected from the group consisting of lithium, magnesium, sodium, and aluminum.

10. A method as set forth in claim 5 wherein the zinc pyrophosphate is powdered.

11. A method as set forth in claim 5 wherein the stearate metal salt is one or more types of metal salt of a stearic acid or a hydroxystearic acid and the stearate metal salt comprises one or more metals selected from the group consisting of lithium, magnesium, sodium, and aluminum.

12. The lubricating grease composition of claim 1 wherein the zinc pyrophosphate is present in an amount of 1 to 15 wt. % of the lubricating grease composition.

13. A method as set forth in claim 5 wherein the zinc pyrophosphate is present in an amount of 1 to 15 wt. % of the lubricating grease composition.

* * * * *